United States Patent [19]

O'Connor

[11] 4,313,327

[45] Feb. 2, 1982

[54] EXTRUSION DIE FOR FORMING MULTI-PASSAGE TUBULAR MEMBERS

[75] Inventor: Joseph M. O'Connor, Chicago, Ill.

[73] Assignee: Peerless of America, Inc., Chicago, Ill.

[21] Appl. No.: 108,810

[22] Filed: Dec. 31, 1979

[51] Int. Cl.[3] ..... B21C 23/08

[52] U.S. Cl. ..... 72/265; 425/132; 425/381; 425/466

[58] Field of Search ..... 72/265, 269, 264, 253 R; 425/132, 381, 380, 466; 264/167, 174, 177 R, 280; 164/85, 421; 65/88

[56] References Cited

U.S. PATENT DOCUMENTS

| | | | |
|---|---|---|---|
| 3,074,107 | 1/1963 | Mase et al. | 425/380 |
| 3,229,722 | 1/1966 | Kritzer | 138/39 |
| 3,240,583 | 3/1966 | Holler | 65/88 |
| 3,479,422 | 11/1969 | Zavasnik | 425/504 |

*Primary Examiner*—Roscoe V. Parker

*Attorney, Agent, or Firm*—Emrich, Root, Lee, Brown & Hill

[57] ABSTRACT

An extrusion die for forming a multi-passage, elongated tubular member having transverse passageways formed between adjacent longitudinally extending passageways during the extrusion of the tubular member.

10 Claims, 9 Drawing Figures

EXTRUSION DIE FOR FORMING MULTI-PASSAGE TUBULAR MEMBERS

BACKGROUND OF THE INVENTION

This invention relates to extrusion dies, and, more particularly, to extrusion dies for extruding multi-passageway tubular members in such a manner as to afford ports or passageways through the partition walls separating the adjacent longitudinally extending passageways in the tubular member.

A primary object of the present invention is to afford a novel extrusion die.

Multi-passageway tubular members have been heretofore known in the art, being shown, for example, in U.S. Pat. Nos. 3,202,212, issued Aug. 24, 1965 to Richard W. Kritzer, 3,746,086, issued July 17, 1973 to Stephen F. Pasternak, and 3,781,959, issued Jan. 1, 1974 to Joseph M. O'Connor, and the like. Such tubular members have many uses, such as, for example, as heat exchangers in the nuclear industry field, the power industry field, the cryogenic industry field and the petro-chemical industry field, and the like. In many instances, in such fields, the same amount of liquid coolant is fed into each of the passageways of the tubular member from a compressor, and the material to be cooled, such as, for example, air, gas or liquid flows transversely across the exterior of the tubular member from one passageway to the other. In such instances, it has been found that, oftentimes, only the coolant in the first passageway or the first few passageways in the direction of flow of the material being cooled, is completely evaporated, with the coolant in the other passageways, progressively across the tubular member, having an increasing amount of coolant remaining therein in liquid form. Inasmuch as, normally, the compressor to which the return line from the tubular member is connected does not properly operate when liquid, rather than gas, is fed thereinto, accumulators, and the like, have commonly been incorporated in such return lines to boil off the liquid and insure that it has been converted to gas before the coolant is fed back into the compressor.

Multi-passageway tubular members having interconnections between the passageways thereof, for the purpose of endeavoring to alleviate the aforementioned problem of having liquid remaining in part of the longitudinal passageways in the tubular member, when the coolant is fed back into the return line to a compressor, have been heretofore known in the art, being shown, for example, in U.S. Pat. No. 3,229,722, issued Jan. 18, 1966 to Richard W. Kritzer. However, insofar as is known, whenever one-piece, multi-passageway tubular members, having internal inter-connections between adjacent passageways, have been heretofore afforded, the inter-connections have been formed by cutting or gouging an opening in the partition wall after the tubular member has been formed. It is an important object of the present invention to afford improvements over the manner in which such multi-passageway tuublar members, having interconnections between the adjacent passageways thereof, have been formed.

Another object of the present invention is to enable multi-passageway tubular members, having internal inter-connections between adjacent passageways, to be extruded in a novel and expeditious manner whereby the inter-connections between the adjacent passageways are formed during the extrusion process.

Another object of the present invention is to afford a novel method of forming multi-passageway tubular members having internal inter-connections between adjacent passageways.

A further object of the present invention is to afford a novel extrusion die for extruding multi-passageway tubular members, wherein internal inter-connections between adjacent passageways may be formed during the extruding process.

Another object of the present invention is to afford a novel extrusion die of the aforementioned type which is practical and efficient in operation, and which may be readily and economically produced commercially.

Other and further objects of the present invention will be apparent from the following description and claims and are illustrated in the accompanying drawings which, by way of illustration, show a preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

An extrusion die 1, of the type adapted to be attached to an extruder, not shown, is shown in FIGS. 1–4 of the drawings to illustrate the presently preferred embodiment of the present invention.

Figure 1:
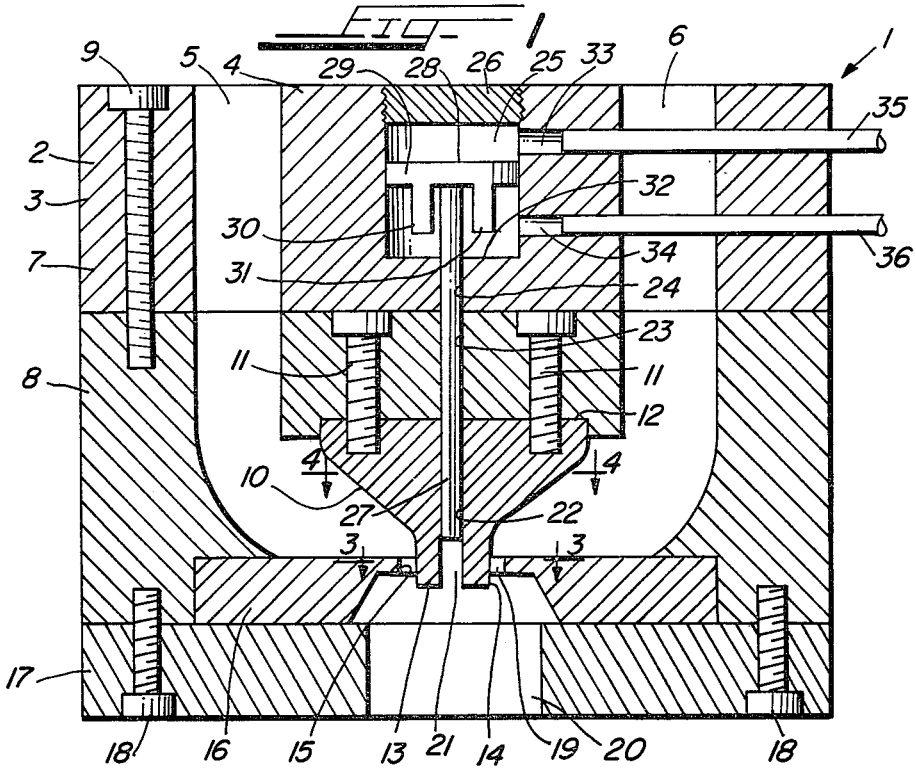
FIG. 1 is a sectional view through an extrusion die embodying the principles of the present invention.
Figure 2:
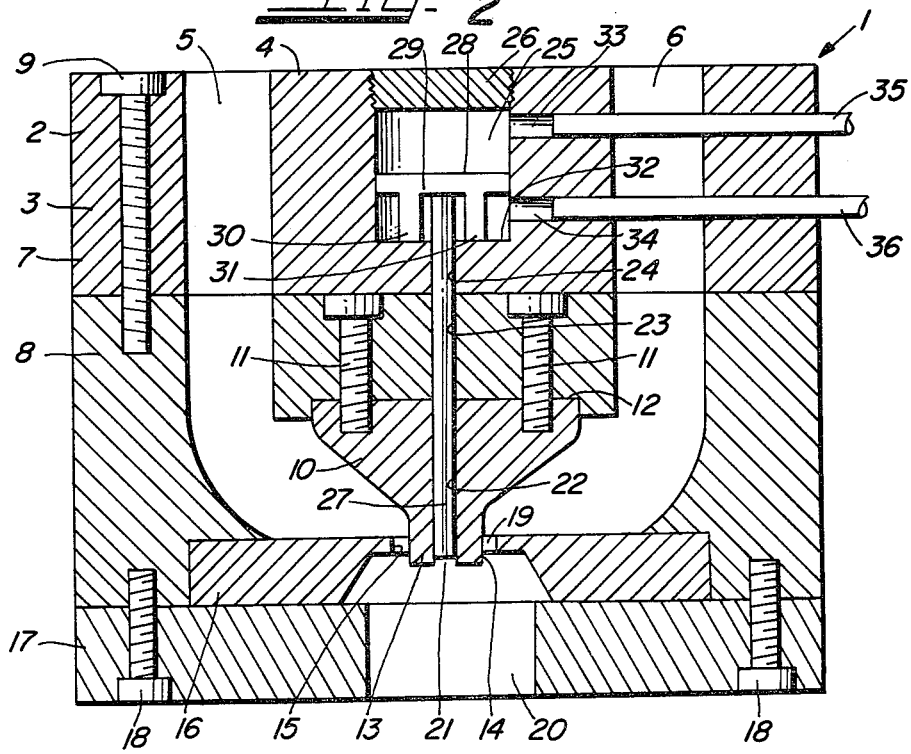
FIG. 2 is a sectional view similar to FIG. 1, but showing certain parts in different operative position.

The extrusion die 1 embodies a die head 2, which includes a main body portion 3 having a mandrel 4 extending transversely thereacross between two openings or passageways 5 and 6, which extend vertically, as viewed in FIGS. 1 and 2, throughout the full height of the die head 2. The die head 2 is made in two sections, an upper section 7 and a lower section 8, secured together by suitable fastening means, such as a plurality of bolts spaced therearound, one such bolt 9 being shown in FIGS. 1 and 2.

A core 10 is secured to the lower face of the mandrel 4 by suitable fastening means such as bolts 11 in downwardly projecting relation thereto. The core 10 is oblong in transverse cross sectional shape, and tapers inwardly from the upper face 12 thereof to a bottom end portion 13, which has substantially vertically extending outer side faces 14, FIGS. 1 and 2.

The bottom end portion 13 of the core 10 projects downwardly through a substantially oblong-shaped opening 15 in a die plate 16, which is clamped between the bottom face of the body portion 3 of the die 2 and an underlying bolster 17 secured to the body portion 3 by suitable fastening means such as bolts 18. The lower end portion 13 of the core 10 is smaller in transverse cross sectional size than the opening 15 through the die plate 16, and is centered therein to thereby define a substantially oblong passageway 19 through the opening 15, between the die plate 16 and the lower end portion 13 of the core 10, FIGS. 1–3. The bolster 17 has an opening 20 extending vertically therethrough in axial alignment with the opening 15 for the passage of an extrusion therethrough outwardly from the die head 2, as will be discussed in greater detail presently.

Figure 3:
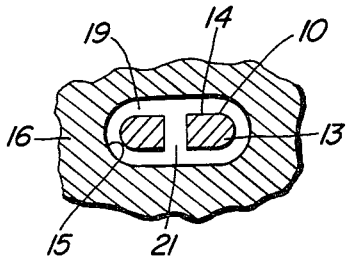
FIG. 3 is a fragmentary, detail sectional view taken substantially along the line 3—3 in FIG. 1.

The lower end portion 13 of the core 10 has an opening 21 which extends transversely across the full width thereof, and vertically through the full height thereof, FIGS. 1 and 3. A round opening 22, which has the same diameter as the thickness of the passageway 21, extends upwardly through the core 10 from the top of the passageway 21, FIGS. 1 and 4. The opening 22 is disposed in communication with and in axial alignment with similar openings 23 and 24 in the lower and upper portions of the mandrel 4, respectively, FIG. 1. The opening 24 in the upper portion of the mandrel 4 terminates at its upper end in centered communication with a cylinder 25 formed in the upper portion of the mandrel 4, the upper end of the cylinder 25 being closed by a removable plug 26, FIGS. 1 and 2.

An elongated pin or rod 27, which forms the lower end portion of a piston 28, FIGS. 1 and 2, is slidably mounted in the openings 22–24 for vertical reciprocation therein between a raised position, as shown in FIG. 1, wherein it is disposed above the top of the passageway 21 through the lower end portion 13 of the core 10 and a lowered position, as shown in FIG. 2, wherein it projects downwardly into the passageway 21 to a level below the passageway 19 through the die plate 16, for a purpose which will be discussed in greater detail presently. The pin 27 preferably is of such cross sectional size that it is disposed in the openings 22–24 and the passageway 21 with a snug, but freely slidable fit. With this construction, when the pin 27 is disposed in the aforementioned lowered position, shown in FIG. 2, it is effective to partially close the passageway 21 for a purpose which will be discussed in greater detail presently.

The piston 28 embodies a piston head 29 mounted on the upper end of the pin 27 and disposed in the cylinder 25 with a snug, freely slidable fit, for vertical reciprocation therein between the raised position, shown in FIG. 1, and the lowered position, shown in FIG. 2. Stop members, in the form of lugs 30 and 31 project downwardly from the piston head 29 at diametrically opposite sides thereof. The stop members 30 and 31 are of such vertical length that, when the piston 29 is disposed in the aforementioned raised position, they are disposed in upwardly spaced relation to the bottom wall 32 of the cylinder 25, and, when the piston 25 is disposed in fully lowered position, they are disposed in abutting engagement with the bottom wall 32 of the cylinder 25, as shown in FIG. 2.

Two passageways 33 and 34 extend radially outwardly from the upper and lower end portions of the cylinder 25 through the body portion 3 of the die head 2 and may be connected to a suitable source of working fluid, such as, for example, compressed air, by any suitable means, such as pipes 35 and 36, respectively, FIGS. 1 and 2. In FIGS. 1 and 2, the passageways 33 and 34 are shown disposed in such postiion on the circumference of the cylinder 25 that the pipes 35 and 36 extend through the passageway 6. However, this is merely by way of illustration, and it will be appreciated by those skilled in the art that, in practice, the passageways 33 and 34 may be so disposed on the circumference of the cylinder 25 that it is unnecessary for the pipes 35 and 36 to cross the passageway 6.

With this construction, when it is desired to lower the piston 28 from the position shown in FIG. 1 to the position shown in FIG. 2, working fluid may be fed inwardly through the pipe 35 and exhausted from the pipe 36 to thereby force the piston 28 downwardly; and when it is desired to raise the piston 28 from the lowered position shown in FIG. 2 to the raised position shown in FIG. 1 working fluid may be fed inwardly through the pipe 36 and exhausted from the pipe 35 to thereby move the piston 28 upwardly. Any suitable controls, not shown, which are well known in the art may be used for thus controlling the flow of working fluid through the pipes 35 and 36 and the passageways 33 and 34.

Figure 5:
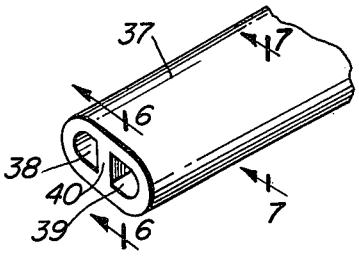
FIG. 5 is a fragmentary perspective view of a tubular member, illustrating the type of tubular member produced by the extrusion die shown in FIG. 1.
Figure 6:
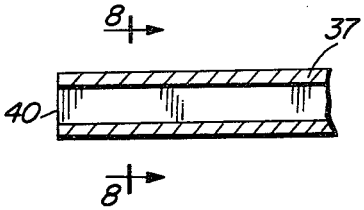
FIG. 6 is a fragmentary, longitudinal sectional view taken substantially along the line 6—6 in FIG. 5.
Figure 8:
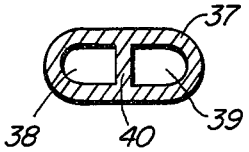
FIG. 8 is a sectional view taken substantially along the line 8—8 in FIG. 6.

With the extrusion die 1 constructed in the aforementioned manner, tube-forming material, such as, for example, aluminum may be fed under pressure from an extruder, not shown, into the tops of and downwardly through the passageways 5 and 6, from which it is forced through the passageway 19 between the lower end portion 13 of the core 10 and the die plate 16, as well as through the passageway 21 in the core 10, to thereby form a multi-passageway tubular member, such as the tubular member 37, shown in FIGS. 5, 6 and 8, having two passageways 38 and 39 extending longitudinally therethrough on opposite sides of an intermediate wall 40, the tubular member passing downwardly through the opening 15 in the die plate 16 and the opening 20 in the bolster 17. Such operation is effective to form the tubular member 37 with a solid intermediate wall 40, as shown in FIGS. 5, 6 and 8.

Figure 7:
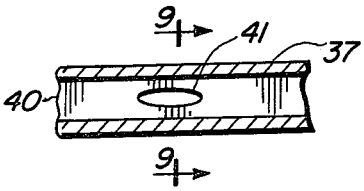
FIG. 7 is a fragmentary longitudinal sectional view taken substantially along the line 7—7 in FIG. 5.
Figure 9:
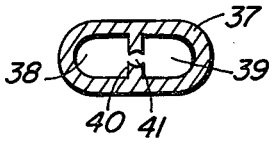
FIG. 9 is a sectional view taken substantially along the line 9—9 in FIG. 7.
Figure 4:
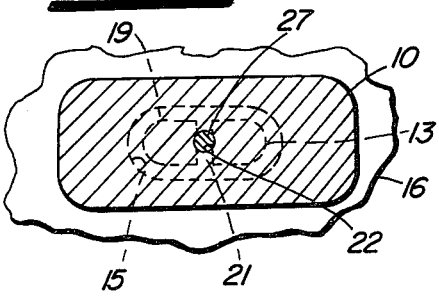
FIG. 4 is a fragmentary detail sectional view taken substantially along the line 4—4 in FIG. 1.

However, the extrusion die 1 is also operable to form apertures in an intermediate partition wall of an elongated tubular member, such as, for example, in the partition wall 40 of the tubular member 37. This may be accomplished by actuating the piston 28 in the aforementioned manner to thereby cause it to move downwardly from the raised position shown in FIG. 1 to the lowered position shown in FIG. 2. When this occurs, the pin 27 moves downwardly into position to block the flow of the tube-forming material through the central portion of the passageway 21 in the lower end portion 13 of the core 10. This causes an interruption in the flow of tube-forming material, necessary to form the partition wall 40 and, therefore, causes an aperture, such as the aperture 41, FIGS. 7 and 9, to be formed in the partition wall 40. When the piston 28 is again moved upwardly into raised position, to thereby move the pin 27 upwardly into the position shown in FIG. 1, wherein it is disposed above the passageway 21 in the lower end portion 13 of the core 10, the flow of tube-forming material through the central portion of the passageway 21 again resumes to thereby form a solid intermediate wall portion in the wall 40, as illustrated in FIGS. 6 and 8. By periodically lowering and then raising the piston 28 in the aforementioned manner, during the extrusion of a tubular member, such as the tubular member 37, openings 41 may be correspondingly periodically formed in the partition wall 40. Normally, the actuation of the piston 28 into lowered position is effected at substantially spaced intervals, and for only relatively short intervals of time, such as, for example, after a ten inch length of solid intermediate wall 40 has been formed, and then only for a sufficient length of time to form an aperture 41 having a length of one inch.

It is to be observed that in the die 1 shown in the drawings, the pin 27 is round and has a diameter that is less than the width of the slot 21, and therefore is effective to cause the formation of an aperture 41, which has a width substantially less than that of the partition wall 40 of the tubular member 37. However, as will be appreciated by those skilled in the art, this is merely by way of illustration and not by way of limitation, and pins of different shapes and sizes may be used without departing from the broader aspects of the present invention. For example, a pin that is rectangular in cross-section, and which has a width substantially equal to the transverse width of the slot 21 could be used to effect the formation of an aperture, corresponding to the aperture 21, which has a width equal to the full width of the wall 40 of the tubular member 37.

With the extrusion die 1 constructed and operable in the aforementioned manner, it will be seen that a multi-passageway tubular member, having apertures extending through the intermediate partition wall thereof at selected intervals, may be readily formed without any interruption in the operation of extruding the overall length of the tubular member being formed.

As will be appreciated by those skilled in the art, the core 10 and the opening 15 are shown herein as being oblong in shape merely by way of illustration and not by way of limitation, and they may be of other shapes, such as, for example, round, rectangular, and the like, without departing from the purview of the broader aspects of the present invention.

Also, as will be appreciated by those skilled in the art, although a die for forming a two-passageway tubular member is shown herein, this is merely by way of illustration and not by way of limitation, and dies for forming tubular members having a greater number of passageways may be afforded without departing from the purview of the broader aspects of the present invention.

From the foregoing, it will be seen that the present invention affords a novel extrusion die.

Also, it will be seen that the present invention affords a novel extrusion die for extruding a multi-passage tubular member having apertures or ports periodically formed in the intermediate partition wall of the tubular member.

In addition, it will be seen that the aforementioned invention affords a novel extrusion die wherein the parts thereof are constituted and arranged in a novel and expeditious manner.

Also, it will be seen that the present invention affords a novel extrusion die which is practical and efficient in operation, and which may be readily and economically produced commercially.

Thus, while I have illustrated and described the preferred embodiment of my invention, it is to be understood that this is capable of variation and modification, and I therefore, do not wish to be limited to the precise details set forth, but desire to avail myself of such changes and alterations as fall within the purview of the following claims.

I claim:

1. An extrusion die for the extrusion of an elongated multi-passageway tubular member having a partition wall disposed between two adjacent, longitudinally extending passageways, said die comprising
   a. a body portion,
   b. a die plate
      (1) mounted on one side of said body portion, and
      (2) having an opening extending therethrough,
   c. a core
      (1) mounted on said body portion, and
      (2) having a portion disposed in said opening in spaced relation to said die plate in position to define an annular passage through said opening in said die plate
   d. said portion of said core having another passageway
      (1) opening outwardly therethrough away from said body portion, and
      (2) extending transversely thereacross for interconnecting opposite sides of said first mentioned passageway, and
   e. said body portion having passage means therein for feeding tube-forming material therethrough into surrounding relation to said portion of said core for passage outwardly from said die plate through said first mentioned and other passageways to thereby form an extruded, elongated tubular member having a longitudinally extending, internal partition wall disposed between two adjacent, longitudinally extending passageways, and
   f. means mounted in said core for interrupting the flow of said tube-forming material through said other passageway and thereby forming an opening through said partition wall.

2. An extrusion die as defined in claim 1, and in which
   a. said last mentioned means comprises an elongated member, longitudinally reciprocable into and out of said other passageway.

3. An extrusion die as defined in claim 2, and in which
   a. said elongated member
      (1) is of a cross-sectional size which is smaller than the length of said other passageway between said opposite sides of said first mentioned passageway, and
      (2) is so reciprocable transversely to said length of said other passageway.

4. An extrusion die as defined in claim 2, and in which
   a. said elongated member comprises one end portion of a piston reciprocably mounted in said body portion,
   b. said piston includes a head at the other end thereof and reciprocably mounted in a cylinder in said body portion, and
   c. said body portion includes means for feeding working fluid into and out of said cylinder on opposite sides of said head for thereby reciprocating said head in said cylinder and said elongated member into and out of said other passageway.

5. An extrusion die as defined in claim 4, and
   a. which includes a bolster mounted on said body portion on the side of said die plate remote from said cylinder, and
   b. in which said bolster has an opening therethrough in alignment with said first mentioned passageway for passage of such an extrusion outwardly therethrough.

6. An extrusion die for the extrusion of an elongated multi-passageway tubular member having a partition wall disposed between two adjacent, longitudinally extending passageways, said die comprising a. a body portion having an upper portion and a lower portion releasably secured together, b. said upper and lower portions each having an outer portion and a central portion extending transversely to said outer portion, c. a die plate (1) releasably mounted on the side of said body portion, remote from upper portion, and (2) having an opening extending therethrough, d. a core (1) releasably mounted on the side of said lower portion remote from said upper portion, and (2) having a portion disposed in said opening in spaced relation to said die plate in position to define an annular passage through said opening in said die plate e. said portion of said core having another passageway (1) opening outwardly therethrough away from said body portion, and (2) extending transversely thereacross for interconnecting opposite sides of said first mentioned passageway, and f. said body portion having passage means extending through said outer portion and said inner portion from the side of said upper portion remote from said lower portion to said core for feeding tube-forming material therethrough into surrounding relation to said portion of said core for passage outwardly from said die plate through said first mentioned and other passageways to thereby form an extruded, elongated tubular member having a longitudinally extending, internal partition wall disposed between two adjacent, longitudinally extending passageways, and g. means mounted in said core for interrupting the flow of said tube-forming material through said other passageway and thereby forming an opening through said partition wall.

7. An extrusion die as defined in claim 6, and in which a. said last mentioned means comprises an elongated member, longitudinally reciprocable into and out of said other passageway.

8. An extrusion die as defined in claim 7, and in which a. said elongated member (1) is of a cross-sectional size which is smaller than the length of said other passageway between said opposite sides of said first mentioned passageway, and (2) is so reciprocable transversely to said length of said other passageway.

9. An extrusion die as defined in claim 7, and a. in which (1) said elongated member comprises one end portion of a piston reciprocably mounted in said body portion, (2) said piston includes a head at the other end thereof and reciprocably mounted in a cylinder in said upper portion of said body portion, and (3) said body portion includes means for feeding working fluid into and out of said cylinder on opposite sides of said head for thereby reciprocating said head in said cylinder and said elongated member into and out of other passageway.

10. An extrusion die as defined in claim 9, and a. which includes a bolster mounted on said body portion on the side of said die plate remote from said cylinder, and b. in which said bolster has an opening therethrough in alignment with said first mentioned passageway for passage of such an extrusion outwardly therethrough.

* * * * *